US009048566B2

(12) United States Patent
Wu et al.

(10) Patent No.: US 9,048,566 B2
(45) Date of Patent: Jun. 2, 2015

(54) CABLE ASSEMBLY HAVING IMPROVED STRAIN RELIEF

(71) Applicants: Jerry Wu, Irvine, CA (US); Jun Chen, Kunshan (CN); Jia-Chao Yan, Kunshan (CN)

(72) Inventors: Jerry Wu, Irvine, CA (US); Jun Chen, Kunshan (CN); Jia-Chao Yan, Kunshan (CN)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 228 days.

(21) Appl. No.: 13/724,166

(22) Filed: Dec. 21, 2012

(65) Prior Publication Data

US 2013/0164969 A1 Jun. 27, 2013

(30) Foreign Application Priority Data

Dec. 23, 2011 (CN) ..... 2011 1 0437635

(51) Int. Cl.
*H01R 13/56* (2006.01)
*H01R 13/58* (2006.01)

(52) U.S. Cl.
CPC ..... *H01R 13/582* (2013.01); *H01R 13/562* (2013.01); *H01R 13/5825* (2013.01)

(58) Field of Classification Search
CPC . H01R 13/582; H01R 13/5825; H01R 13/562
USPC ..... 439/445–449, 460–465
See application file for complete search history.

(56) References Cited

U.S. PATENT DOCUMENTS

| | | | | |
|---|---|---|---|---|
| 2,189,987 | A * | 2/1940 | Kellems | 439/447 |
| 3,522,578 | A * | 8/1970 | Newman | 439/447 |
| 5,874,709 | A | 2/1999 | New et al. | |
| 7,041,935 | B2 * | 5/2006 | Raymond et al. | 219/121.48 |
| 7,445,484 | B2 | 11/2008 | Wu | |
| 7,445,485 | B1 | 11/2008 | Wu | |

FOREIGN PATENT DOCUMENTS

| | | |
|---|---|---|
| CN | 2718826 | 8/2005 |
| CN | 201708380 | 1/2011 |

* cited by examiner

*Primary Examiner* — Khiem Nguyen
(74) *Attorney, Agent, or Firm* — Ming Chieh Chang; Wei Te Chung

(57) ABSTRACT

A cable assembly includes a connector, a cover enclosing the connector, a strain relief located on the rear end of the cover, a spring, and a cable. The cover includes a blocking. The strain relief is fixed by the blocking. The strain relief defines a through hole and a receiving cavity communicated with the through hole. The through hole has an inner diameter smaller than an inner diameter of the receiving cavity. A shoulder is formed between the through hole and the receiving cavity. The spring is received in the cavity, and has one end restricted by the shoulder and an opposite end restricted by the blocking. The cable is connected to the connector and runs through the spring and the through hole.

7 Claims, 5 Drawing Sheets

CABLE ASSEMBLY HAVING IMPROVED STRAIN RELIEF

BACKGROUND OF THE INVENTION

1. Field of the Invention

The present invention relates to a cable assembly, and more particularly to a cable assembly having a strain relief 2. Description of Related Arts For many types of portable electronic devices, such as personal computers, projectors, players, etc., for easy handling, users often fold a cable connected to the devices when moving around. In this situation, the cable will be bent. In prior art designs, a strain relief is molded on the front end of the cable for preventing the cable from breaking. However, with the miniaturization of the electronic device, the size or appearance of the cable or strain relief is limited as to length or diameter. When a high resistance to bending is demanded, the strain relief of existing designs may not satisfy the flexural test.

U.S. Pat. No. 5,874,709, issued on Feb. 23, 1999 to New et al., discloses a related design. According to the disclosure, a strain relief assembly is used for reducing bending of a cable. The strain relief assembly comprises a sleeve, a resilient coil spring extending generally coaxially with respect to the sleeve, and a connector for attaching the sleeve and the spring. The spring has a tail extending tangentially from one end of the coil for engaging the end of the sleeve to prevent the spring from moving away from the connector. The spring has a relatively small pitch in order to reduce tendency of the spring to catch on surrounding objects.

SUMMARY OF THE INVENTION

An object of the present invention is to provide a cable assembly having a reinforced strain relief structure.

To achieve the above-mentioned object, a cable assembly includes a connector, a cover enclosing the connector, a strain relief located on the rear end of the cover, a spring, and a cable. The cover includes a blocking. The strain relief is fixed by the blocking. The strain relief defines a through hole and a receiving cavity communicated with the through hole. The through hole has an inner diameter smaller than an inner diameter of the receiving cavity. A shoulder is formed between the through hole and the receiving cavity. The spring is received in the cavity and has one end restricted by the shoulder and an opposite end restricted by the blocking. The cable is connected to the connector and runs through the spring and the through hole.

Other objects, features and advantages of the invention will be apparent from the following detailed description taken in connection with the accompanying drawings.

DETAILED DESCRIPTION OF THE PREFERRED EMBODIMENT

Reference will now be made in detail to preferred embodiments of the present invention.

Figure 1:
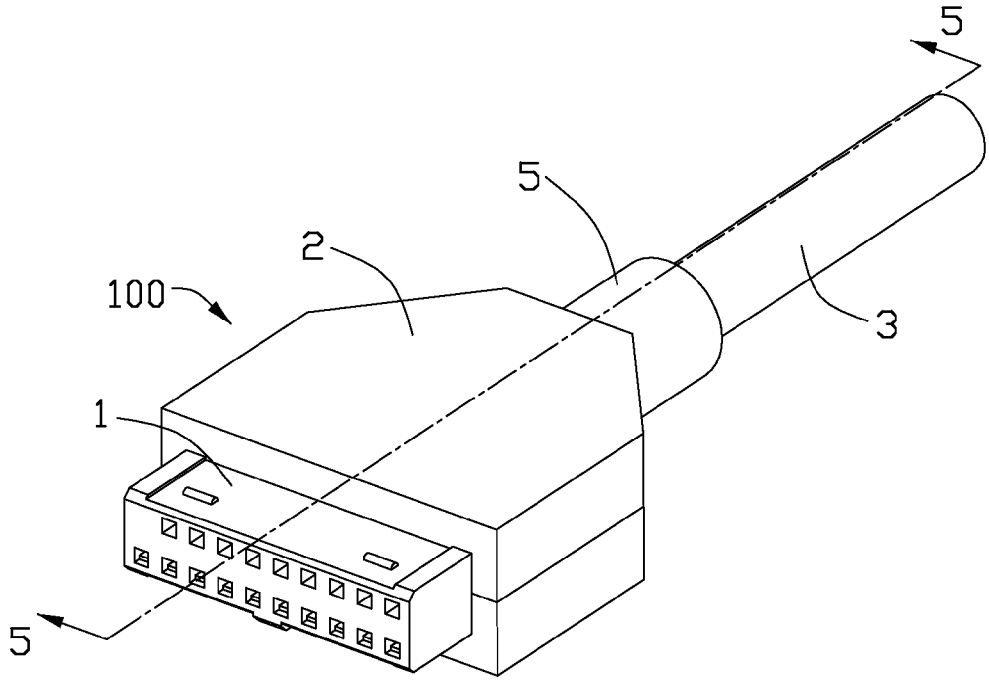
FIG. 1 is a perspective view of a cable assembly in accordance with the present invention.
Figure 2:
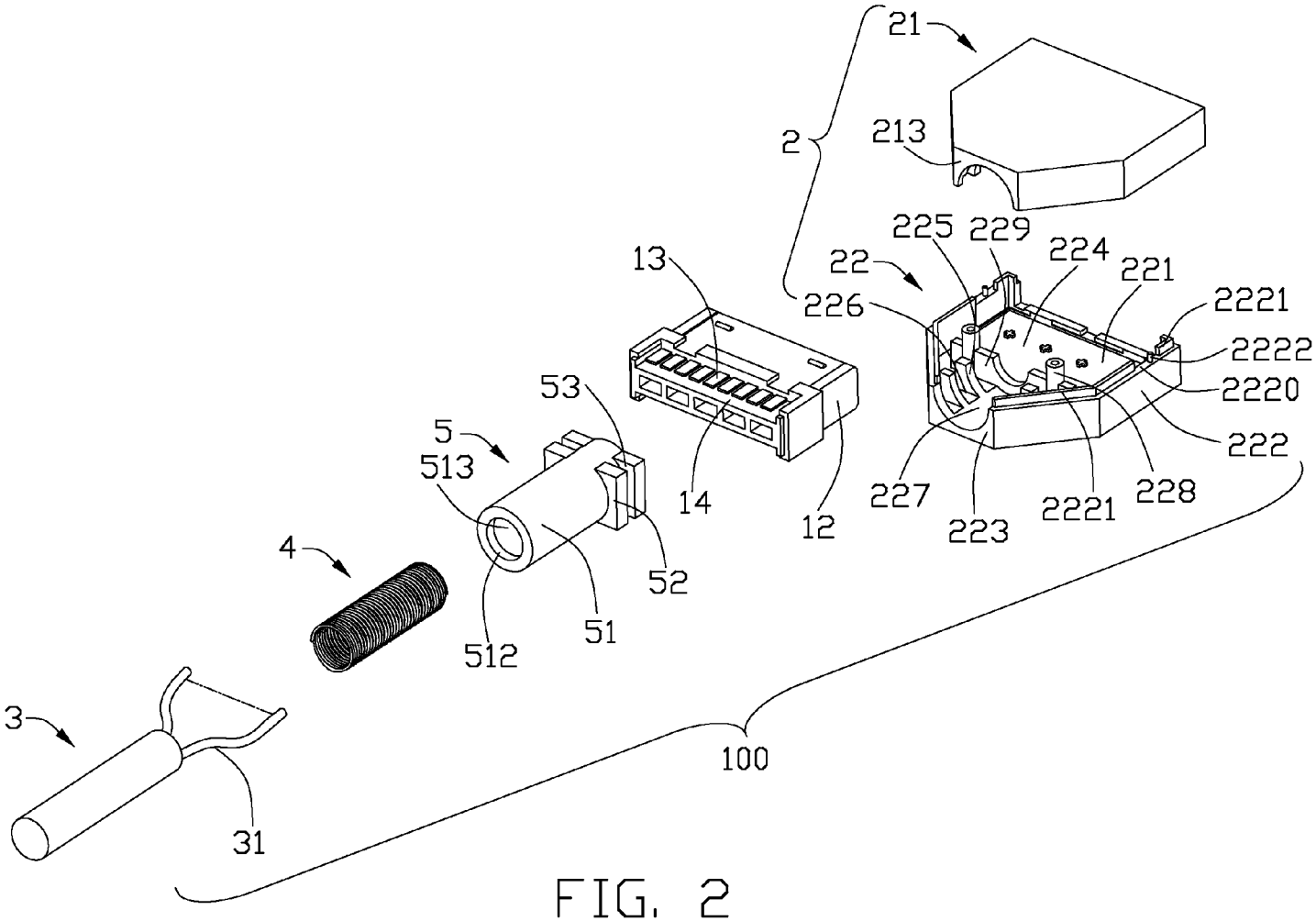
FIG. 2 is an exploded, perspective view of the cable assembly shown in FIG. 1.
Figure 3:
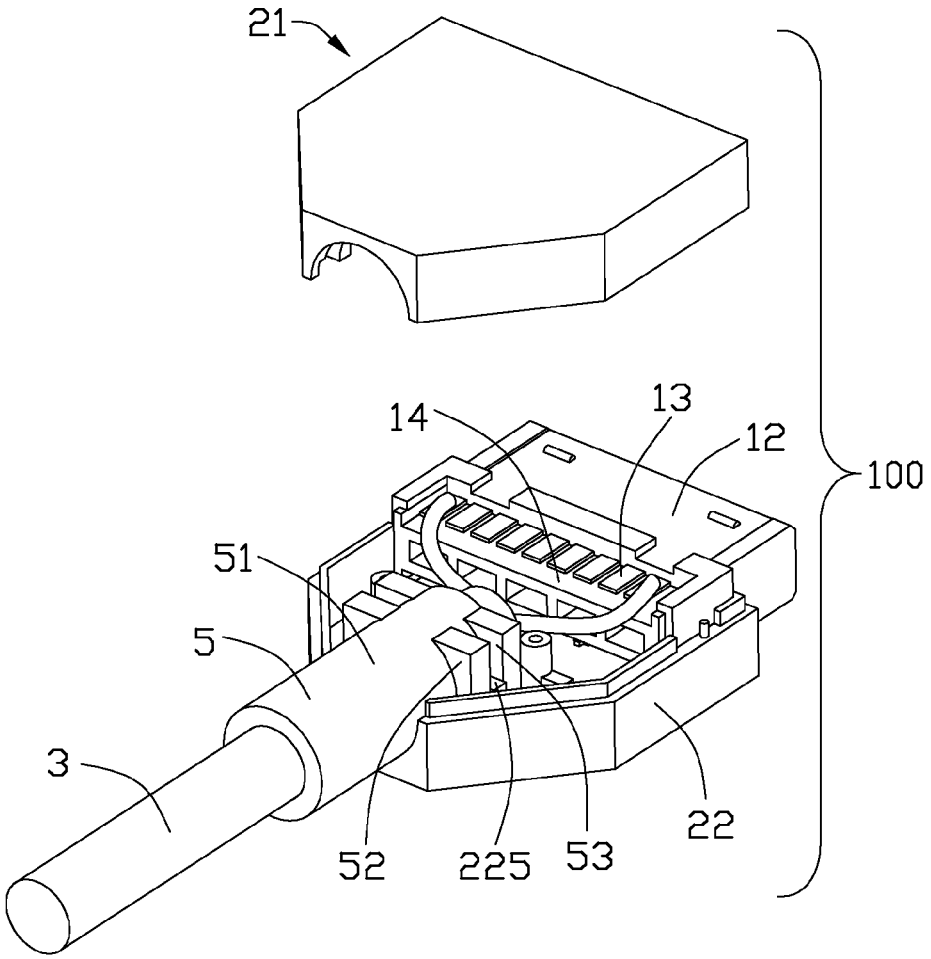
FIG. 3 is a partially assembled, perspective view of the cable assembly shown in FIG. 1.
Figure 4:
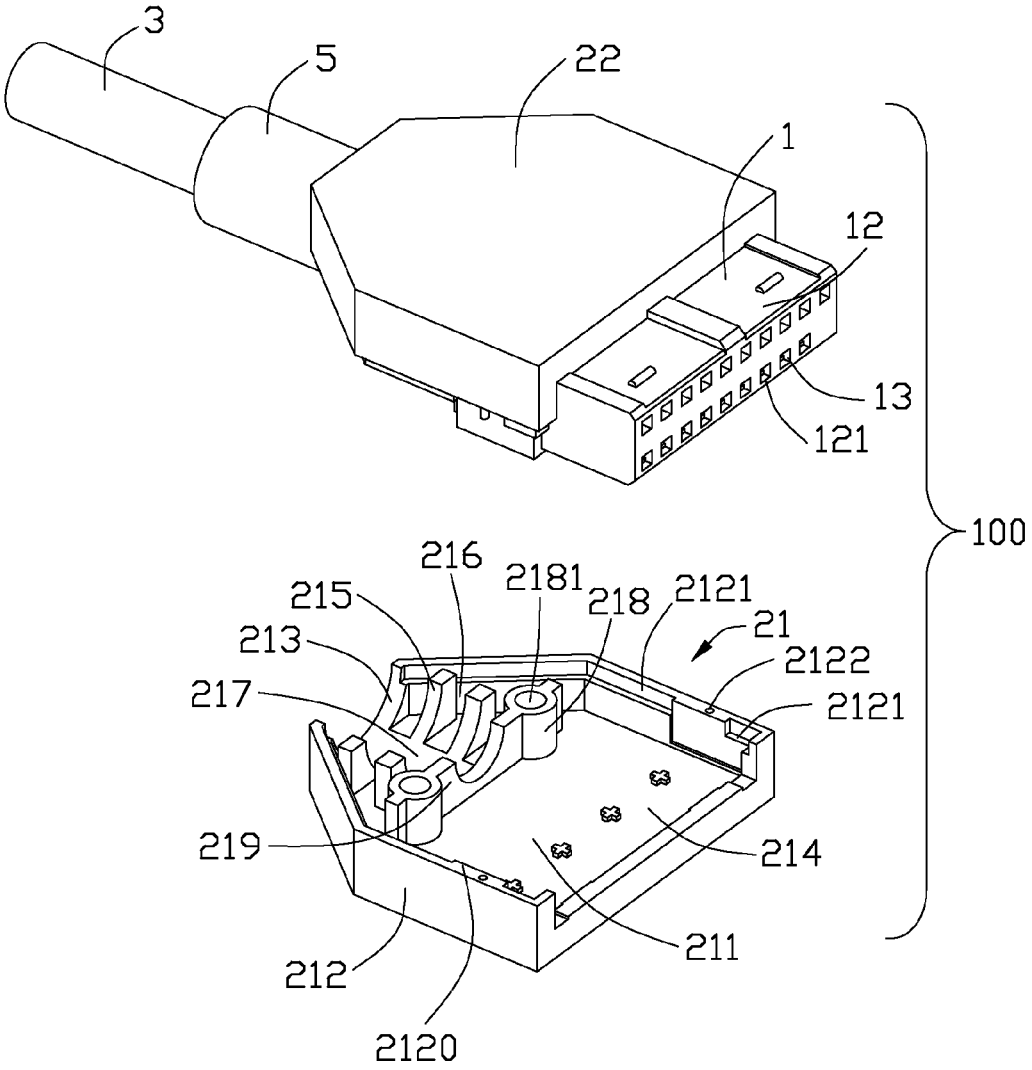
FIG. 4 is a view similar to FIG. 3, but from another aspect.
Figure 5:
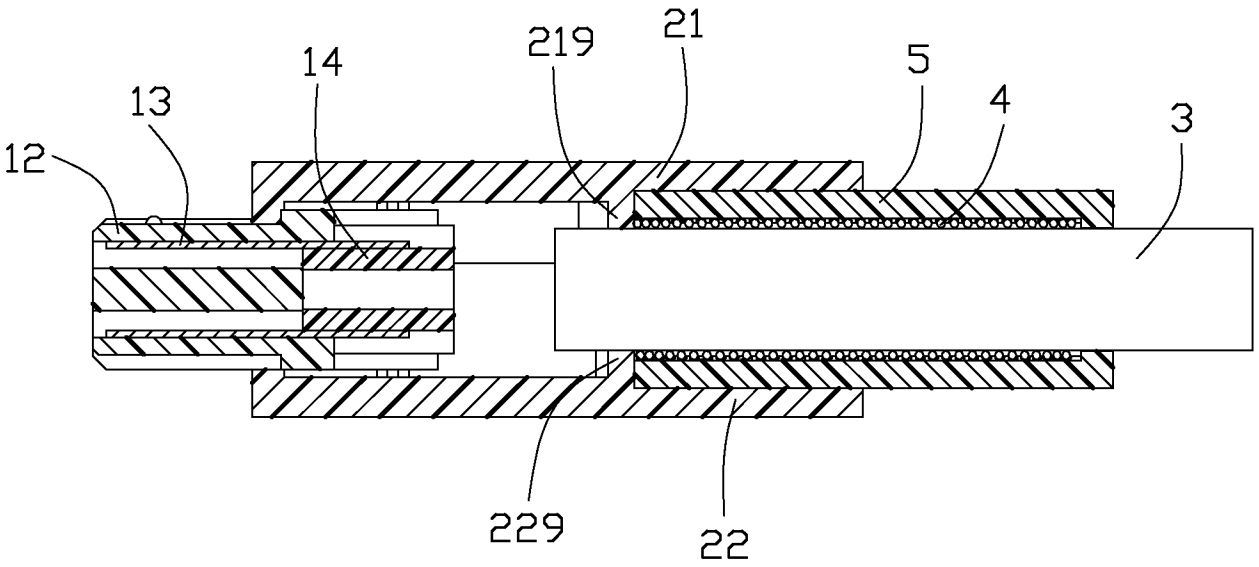
FIG. 5 is a cross-sectional view of the cable assembly taken along 5-5 in FIG. 1.

Referring to FIGS. 1 to 5, a cable assembly 100 in accordance with the present invention comprises a connector 1, a cover 2 enclosing the connector 1, a cable 3 connected to the connector 1, a spring 4 receiving the cable 3, and a strain relief 5 enclosing the spring 4. The spring 4 is used for improving a bending performance of the cable assembly 100.

The connector 1 comprises a housing 12, a plurality of contacts 13 received in the housing 12 and a spacer 14 mounted on the rear end of the housing 12 for supporting the contacts 13. The housing 12 defines a number of passageways 121 penetrating the front and rear surface thereof for receiving the contacts 13, respectively. The rear end of the contact 13 is beyond to the rear surface of the housing 12 and located on the spacer 14. A front portion of the spacer 14 is received in the housing 12, and two lateral sides of the spacer 14 are sandwiched in the housing 12.

The cover 2 comprises an upper cover 21 and a lower cover 22 assembled on the upper cover 21. The upper cover 21 comprises an upper wall 211, a pair of lateral walls 212 extending downwardly from the upper wall 211 and a rear wall 213 connected to the two lateral walls 212. An upper receiving groove 214 is surrounded by both the upper cover 211 and lateral walls 212, and located on the front end of the upper cover 21. At least a pair of ribs 215 are raised downwardly from the inner surface of the upper wall 211. In this embodiment, the number of the ribs 215 is two pairs. Slots 216 are formed between two adjacent ribs 215, or between the rib 215 and the rear wall 213. An upper mounted groove 217 is recessed upwardly from the surfaces of the ribs 215 and the rear wall 213. The slots 216 are located at two sides of the upper mounted groove 217. The ribs 215 are located behind the upper receiving groove 214. A pair of cylinders 218 are raised downwardly from the upper wall 211, and located between the ribs 215 and the upper receiving groove 214. A receiving hole 2181 is recessed upwardly from the surface of the cylinder 218. A blocking or retainer 219 projects downwardly from inner surface of the upper wall 211 and located in the front of the ribs 215. Holder slots 2121 and mating holes 2122 are recessed upwardly from a mating surface 2120 of the lateral walls 212, respectively.

The lower cover 22 comprises a lower wall 221, a pair of lateral walls extending upwardly from the lower wall 221 and a rear wall 223 connected to two lateral walls 222. A lower receiving groove 224 is surrounded by both the lower wall 221 and the lateral walls 222. The lower receiving groove 224 is located on the front of the lower cover 22. Both the upper and lower receiving groove 214, 224 are together formed a receiving groove for receiving the housing 12. A pair of ribs 225 is raised upwardly from the inner surface of the lower wall 221. In this embodiment, two pairs of ribs 225 are formed. Slots 226 are formed between two adjacent ribs 225, or between the rib 225 and the rear wall 223. A lower mounted groove 227 is recessed downwardly from the surface of the rear wall 223 and the ribs 225. A mounted groove is formed by the upper and lower mounted groove 217, 227, together. The slots 226 are located at two lateral sides of the lower mounted groove 227. The ribs 225 is located behind the lower receiving groove 224. A pair of cylinders 228 are raised upwardly from the upper wall 221 and located between the ribs 225 and the lower receiving groove 224 for inserting into the receiving holes 2181. A blocking 229 is raised upwardly from inner surface of the lower wall 221 and located in the front of the ribs 225. Tabs 2221 and mating posts 2222 are recessed upwardly respectively from a mating surface 2220 of the lateral walls 222 for coordinating with the holder grooves 2121 and mating holes 2122.

The strain relief 5 comprises a receiving portion 51 receiving the spring 4 and at least a pair of protruding portions 52 extending outwardly from the outer surface of the receiving portion 51. The receiving portion 51 is cylindrical and comprises a receiving cavity 513 recessed rearwardly from the front surface thereof, and a through hole 512 recessed forwardly from the rear surface thereof and communicated with the receiving cavity 513. The through hole 512 has an inner diameter is smaller than an inner diameter of the receiving cavity 513. A shoulder is formed between the through hole 512 and the receiving cavity 513. In this embodiment, the number of the protruding portions 52 is two pairs. A cutout 53 is formed between two protruding portion 52 for coordinating with the ribs 215, 225.

The spring 4 is a cylinder helix spring having a pair of ends opposite to each other. The spring 4 can be lengthened or shortened along a connecting direction of the two ends. The spring 4 also can be bent into an arc shape. The spring 4 has a outer diameter larger than the diameter of the through hole 512, but smaller than the diameter of the receiving cavity 513.

The spring 4 is received into the receiving cavity 513 from the front surface of the strain relief 5. The shoulder prevent the spring 4 to slide out the strain relief 5. The spring 4 also could be enclosed by the strain relief by means of molding. The strain relief 5 restricts the spring 4 and provides protection to the spring 4, when the spring is bent. An end of the cable 3 is inserted into the strain relief 5 from the rear surface of the strain relief 5 with a free end of the cable 3 extending beyond the front surface of the strain relief 5 and fixed by the blockings 219, 229 of the upper cover 21 and the lower cover 22 to prevent the connecting between the cable 3 and the connector 1. The end of the cable 3 is enclosed by the spring 4. The protruding portions 52 are received in the receiving grooves 216, 226, and The ribs 215, 225 are received in the cutouts 53 of the strain relief 5 to make the strain relief 5 fixed in the cover 2. One end of the spring 4 is restricted to the blockings 219, 229 of the upper cover 21 and the lower cover 22 to prevent the spring 4 to move ahead. The spring 4 has a rigidity stronger than a rigidity of the cable 3 and optionally in a tensioned manner. Therefore, when the cable is bent, the spring 4 can provide a protection to the cable 3. A number of wires 31 of the cable 3 is soldered on the contacts 13 of the connector 1. The connector 1 is retained the receiving groove of the front end of the cover 2. The strain relief 5 is received in the rear end of the cover 2. The receiving portion 51 is received in the mounted groove formed by the upper and lower mounted groove 217, 227. The cylinders 228 are received in the receiving hole 2181 of the cylinders 218 of the upper cover 21. The upper cover 21 is fixed on the lower cover 22 by means of the holder slots 2121 and the mating holes 2122 mating holes 2122 retaining the tabs 2221 and mating posts 2222.

The ribs 215, the slots 216 and the blockings 219 of the upper cove 21 are alignment to the ribs 225, the slots 226 and the blockings 229 of the lower cove 22, respectively. Said components can be seen as an integrated rib, slot and blocking, respectively.

In other embodiments, the receiving cavity 513 of the strain relief 5 has front and rear inner surfaces. The through holes 512 are formed on the front and rear of the receiving cavity 513. The spring 4 is enclosed completely by strain relief 5 and attached to the front and rear inner surfaces.

It is to be understood, however, that even though numerous characteristics of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable connector assembly comprising:

an electrical connector unit including a plurality of contacts therein;

a cable extending along an axial direction and including a plurality of wires electrically connected to the corresponding contacts, respectively;

a cover defining an interior space to enclose a rear portion of the connector unit while exposing a front portion of the connector unit;

a retainer structure formed on an interior face of the cover and facing toward the interior space;

a strain relief extending along said axial direction and having one end fastened to the retainer and the other end fastened upon an exterior face of a front portion of the cable at a root section thereof with a ring type gap between the strain relief and the front portion of the cable; and a coil spring disposed in the ring type gap and surrounding the front portion of the cable with one end abutting against the retainer and the other end abutting against the root section in a tensioned manner along the axial direction.

2. The cable connector assembly as claimed in claim 1, wherein said root section of the strain relief is integrally formed upon the front portion of the cable.

3. The cable connector assembly as claimed in claim 1, wherein the retainer defines a plurality of ribs to abut against the spring and the strain relief.

4. The cable connector assembly as claimed in claim 1, wherein said spring is in a tensioned manner.

5. The cable connector assembly as claimed in claim 1, wherein said wires are directly connected to the corresponding contacts, respectively.

6. A cable connector assembly comprising:

an electrical connector unit including a plurality of contacts therein;

a cable extending along an axial direction and including a plurality of wires electrically connected to the corresponding contacts, respectively;

a cover defining an interior space to enclose a rear portion of the connector unit while exposing a front portion of the connector unit;

a retainer structure formed on an interior face of the cover and facing toward the interior space;

a strain relief extending along said axial direction and having one end engaged with the retainer and the other end integrally formed upon an exterior face of a front portion of the cable at a root section thereof; and a spring defines one section abutting against the retainer and another section abutting against the strain relief in a tensioned manner along said axial direction so as to reinforce said strain relief.

7. The cable connector assembly as claimed in claim 6, wherein said retainer includes a plurality of ribs to abut against the strain relief and the spring, respectively.

* * * * *